United States Patent [19]

Schumacher

[11] 3,938,351

[45] Feb. 17, 1976

[54] COMBINATION LIQUID TRAPPING SUCTION ACCUMULATOR AND EVAPORATOR PRESSURE REGULATOR DEVICE INCLUDING A CARTRIDGE TYPE EXPANSION VALVE

[75] Inventor: Ernest W. Schumacher, Portsmouth, Va.

[73] Assignee: Virginia Chemicals, Inc., Portsmouth, Va.

[22] Filed: Oct. 30, 1974

[21] Appl. No.: 519,304

Related U.S. Application Data

[62] Division of Ser. No. 388,281, Aug. 14, 1973, Pat. No. 3,858,407.

[52] U.S. Cl. ..... 62/217; 62/503

[51] Int. Cl.[2] ..... F25B 41/04; F25B 43/00

[58] Field of Search ..... 62/217, 503, 474, 196, 62/471, 222

[56] References Cited

UNITED STATES PATENTS

| | | | |
|---|---|---|---|
| 2,859,596 | 11/1958 | Evans | 62/503 X |
| 2,936,790 | 5/1960 | Dahl et al. | 62/222 X |
| 3,525,234 | 8/1970 | Widdowson | 62/217 |
| 3,796,064 | 3/1974 | Ladusaw | 62/503 |
| 3,798,921 | 3/1974 | Scherer et al. | 62/503 X |

*Primary Examiner*—William E. Wayner

[57] ABSTRACT

A combination liquid trapping suction accumulator and evaporator pressure regulator device used intermediate the compressor and evaporator in a vapor-compression refrigeration system as a protective device for the compressor. The device is characterized by the positioning of the evaporator pressure regulator chamber intermediate the inlet and outlet ports of the accumulator housing. Thus, evaporator pressure regulation is accomplished simultaneously with liquid accumulation in a compact and readily serviceable, unitary housing.

3 Claims, 2 Drawing Figures

COMBINATION LIQUID TRAPPING SUCTION ACCUMULATOR AND EVAPORATOR PRESSURE REGULATOR DEVICE INCLUDING A CARTRIDGE TYPE EXPANSION VALVE

CROSS REFERENCE TO RELATED APPLICATION:

A modification of the assignee's earlier filed application entitled LIQUID TRAPPING SUCTION ACCUMULATOR (Ser. No. 359,569), filed May 11, 1973 this application is a division of U.S. Ser. No. 388,281, filed 8/14/73, now U.S. Pat. No. 3,858,407.

The present application is characterized in its combining of an evaporator pressure regulator device with a liquid trapping suction accumulator.

BACKGROUND OF THE INVENTION

Automobile air conditioning and refrigeration systems are conventionally subject to a high rate of failure, due principally to liquid entering the compressor. These failures frequently occur after a short shut-down of the automobile which defeats the thermostatic expansion valve, permitting liquid to migrate from the condenser into the evaporator. As the automobile air conditioning system is restarted, the liquid goes to the compressor with damaging results. The automobile system is characterized by the extraordinarily wide range of flow rates, a principal aim being to return the oil through the eductor, regardless of flow rate.

Liquid suction accumulators are widely employed to solve the problem of liquid entering the compressor. However, there is no prior art showing a combination of these elements within a single working system and utilizing pressure drops obtained, for example, through the evaporator pressure regulator as an assistance in the eduction of oil through the system.

SUMMARY OF THE INVENTION

According to the present invention, an evaporator pressure regulator (EPR) is interposed between the inlet and outlet ports of an accumulator chamber. The evaporator pressure regulator (EPR) may include an evaporator pressure regulator device of the bellows or other type, regulating vaporous flow from inlet to outlet, according to pressure within the system. The pressure drop obtained through the evaporator pressure regulator device is utilized in drawing oil through the eductor tube.

Modification of the invention includes positioning of an expansion valve within the accumulator housing, use of a combined thermostatic expansion valve and a filter drier adjacent to the accumulator chamber, positioning of both the expansion valve and a desiccant within the accumulator chamber, utilization of a fixed orifice or capillary feeding device intermediate the filter drier and the evaporator in the system, positioning of the evaporator pressure regulator device perpendicularly with respect to the top of the accumulator chamber and providing the evaporator pressure regulator chamber with quick disconnects, fitting and sealing fixtures. Specifically according to the species illustrated in FIG. 2 the additional functions of solid contaminant removal, filter drying, equalization and location of a cartridge type expansion valve become completely integrated within the accumulator housing.

DESCRIPTION OF THE PREFERRED EMBODIMENTS

Figure 1:
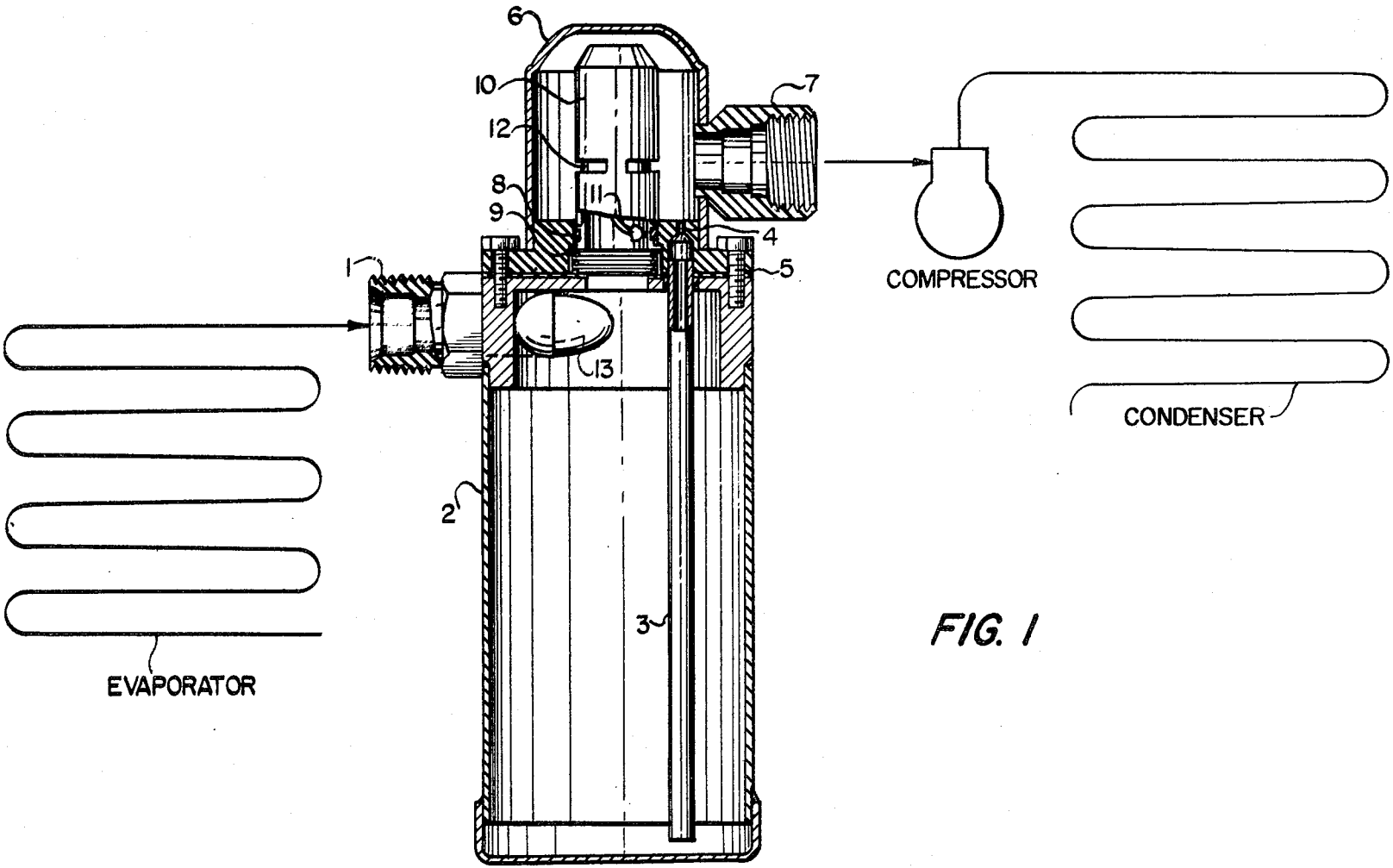
FIG. 1 is a schematic view, partially in vertical section, showing a combined evaporator pressure regulator chamber and accumulator, according to the present invention.

The primary function of a suction accumulator is to prevent liquid refrigerant from entering the compressor. It must also provide positive oil return at all system flow rates. Conventional accumulators are designed to provide adequate pressure drop for positive oil return at minimum system flow rates. However, when systems experience high maximum to minimum flow rate ratios, accumulator pressure drops at high load conditions become excessive. The combining of the EPR and accumulator can solve this problem. The EPR represents a finite pressure drop in the suction line at all operating conditions. In fact, the pressure drop across the EPR is generally greatest at low loads. Integration of the accumulator and the EPR allows the pressure drop across the EPR to be utilized for positive oil return. This arrangement allows the accumulator to be designed for minimum pressure drop while still performing its liquid trapping function. In FIG. 1 the refrigerant-oil mixture is shown entering the accumulator vessel 2 at inlet connection 1. Oil is returned through eductor tube 3 which is connected to outlet orifice 4. Orifice 4 is arranged to bypass the EPR 10, hence taking advantage of its pressure differential for oil return. The oil is mixed with the refrigerant vapors exiting the EPR 10 in chamber 6 and returned to the compressor through outlet connection 7. O-ring 8 provides a positive seal between the inlet and outlet of EPR 10 and compression spring 9 provides positive retention of the EPR 10 in its socket. EPR may be of the bellows-type containing an inert gas such as nitrogen which is charged through nipple 11. Pressure changes move the bellows which moves a spool or slide across peripheral slots 12, so as to regulate vaporous flow. A tangential entry device 13 may be positioned adjacent inlet connection 1, to provide consistent liquid and vapor separation.

Figure 2:
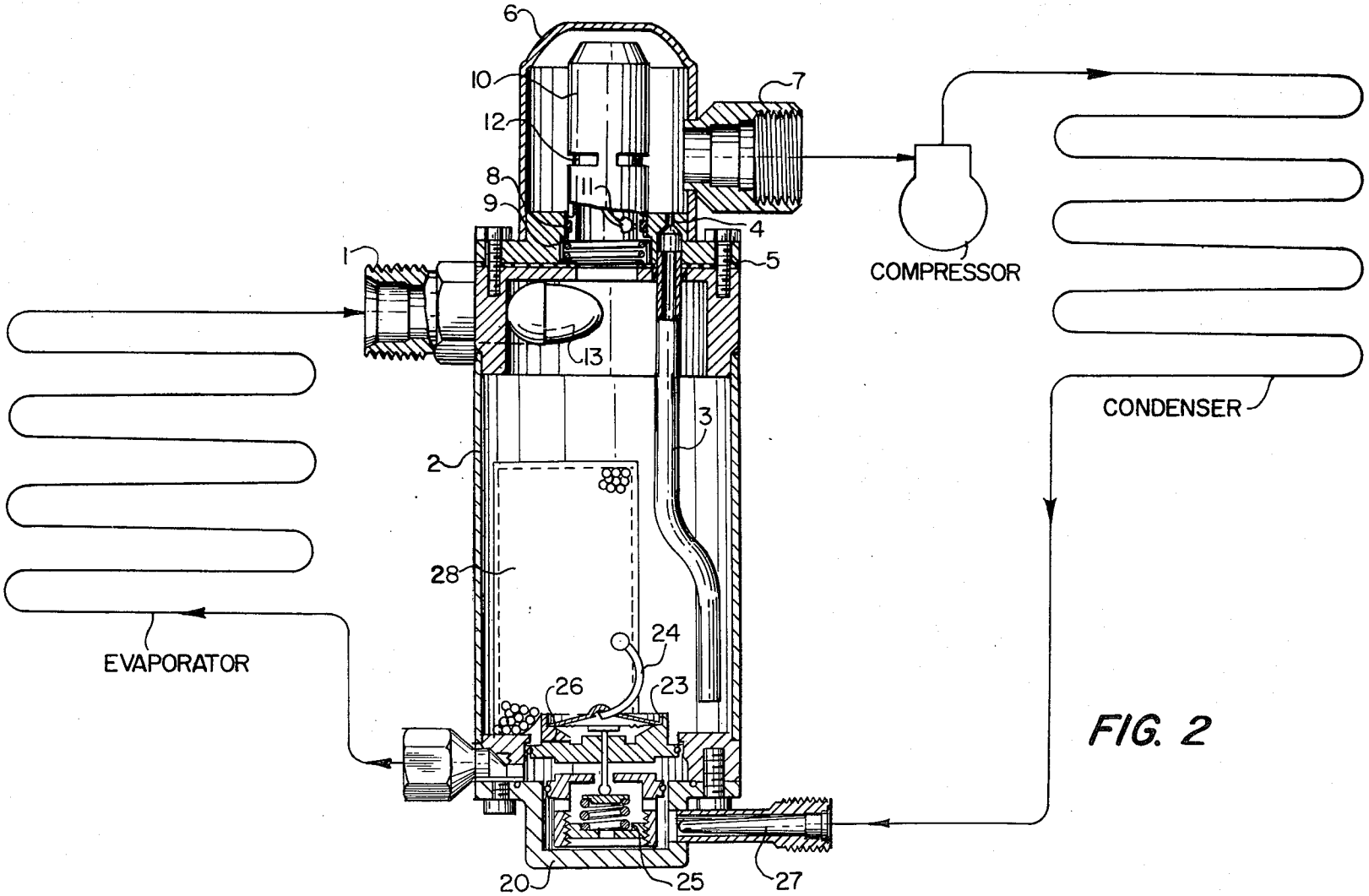
FIG. 2 is a schematic view, partially in vertical section, showing a further modification wherein a cartridge type expansion valve is mounted within the bottom of the accumulator chamber and intermediate the condenser and evaporator in the system, wherein the cartridge type expansion valve includes a fine mesh strainer in its inlet port and the drier element has been mounted directly within the accumulator chamber.

The FIG. 2 system is similar to the one described in FIG. 1, except that a cartridge type 20 expansion valve has been located in the accumulator 2. This arrangement makes possible the elimination of the remote bulb and external equalizer connections normally required with conventional expansion valves. The elimination of these small fragile connections reduces the possibility of system failures caused by fracture of these lines. Serviceability is also enhanced since these connectons do not have to be made during expansion valve replacement.

Expansion valve 20 may include entry port 21, exit port 22, equalizing port 26, diaphragm or bellows 23, charged by nipple 24 and the compression element 25.

FIG. 2 also represents a system with a totally integrated control package and is especially advantageous in that filter-drier as a separate unit has been eliminated, and the contaminant control functions have been added to the combined control package. The EPR-accumulator combination still provides the advantages described in FIG. 1. Removal of moisture and acids is accomplished in the accumulator vessel and solid contaminants are retained in a fine mesh strainer 27 located at the expansion valve inlet 21. Moisture and other contaminant removal may be accomplished in the suction side of many refrigerant systems as effectively as it is done in the high pressure liquid phase. A desiccant bag 28 may be supported within the accumulator 2.

I claim:

1. A liquid trapping suction accumulator adapted for insertion in a vapor-compression refrigeration system between the evaporator and compressor comprising:

A. an accumulator chamber defined by a casing vertically extending and having a top and a bottom;

B. inlet and outlet ports opening into the top of said chamber and respectively adapted for operative connection to said evaporator and said compressor;

C. an evaporator pressure regulator chamber interposed between said inlet and outlet ports in communication with said accumulator chamber, said chamber including:

i. a pressure responsive evaporator pressure regulator device, vertically positioned in said evaporator pressure chamber proximate said outlet port so as to gauge admission of vapor from said accumulator chamber into said evaporator pressure regulator chamber and through said outlet;

D. an eductor tube vertically extending independently from the bottom of said accumulator chamber into said evaporator pressure regulator chamber;

E. a cartridge type expansion valve assembly mounted within the bottom of said accumulator chamber said assembly having an entrance port connected to the condenser in said system with said cartridge type expansion valve mounted within and proximate the bottom of said accumulator casing and including an equalizing port for direct communication between said accumulator bottom and said expansion valve; a wire mesh strainer located in said entrance port and a desiccant bag supported within said accumulator chamber adjacent said expansion valve.

2. The liquid trapping suction accumulator of claim 1, including a tangential entry device positioned in said accumulator chamber adjacent said inlet port, as an assistance in separation of liquid and vapor.

3. The liquid trapping suction accumulator of claim 1 wherein said eductor tube is axially offset so as to accommodate said expansion valve.

* * * * *